US010030499B2

(12) United States Patent
Johnston

(10) Patent No.: US 10,030,499 B2
(45) Date of Patent: Jul. 24, 2018

(54) GEOLOGICAL MONITORING CONSOLE

(75) Inventor: Paul J. Johnston, Houston, TX (US)

(73) Assignee: BP CORPORATION NORTH AMERICA INC., Houston, TX (US)

( * ) Notice: Subject to any disclaimer, the term of this patent is extended or adjusted under 35 U.S.C. 154(b) by 789 days.

(21) Appl. No.: 13/312,646

(22) Filed: Dec. 6, 2011

(65) Prior Publication Data

US 2013/0144531 A1 Jun. 6, 2013

(51) Int. Cl.
*E21B 44/00* (2006.01)
*E21B 47/022* (2012.01)

(52) U.S. Cl.
CPC ..... *E21B 44/00* (2013.01)

(58) Field of Classification Search
CPC ..... E21B 44/00; E21B 47/022
USPC ..... 702/9
See application file for complete search history.

(56) References Cited

U.S. PATENT DOCUMENTS 6,549,854 B1 4/2003 Malinverno et al.
7,003,439 B2 * 2/2006 Aldred et al. ..... 703/10
7,606,666 B2 * 10/2009 Repin et al. ..... 702/9
8,463,549 B1 * 6/2013 Selman ..... E21B 7/04 702/11
2005/0236184 A1 * 10/2005 Veeningen ..... E21B 10/00 175/40
2006/0090934 A1 * 5/2006 Williams ..... E21B 7/04 175/45
2007/0179742 A1 8/2007 Tabanou et al.
2008/0289877 A1 11/2008 Nikolakis-Mouchas et al.
2011/0161133 A1 * 6/2011 Staveley ..... E21B 44/00 705/7.28
2012/0118637 A1 * 5/2012 Wang ..... E21B 44/00 175/24
2012/0130693 A1 * 5/2012 Ertas ..... E21B 44/00 703/2

OTHER PUBLICATIONS

Chia et al., "A New Method for Improving LWD Logging Depth" (2006).*
PCT International Search Report and the Written Opinion of the International Searching Authority, dated Oct. 11, 2013 in International Application No. PCT/US2011/063873, 10 pages.

* cited by examiner

*Primary Examiner* — Mohamed Charioui
(74) *Attorney, Agent, or Firm* — Conley Rose, P.C.

(57) ABSTRACT

A real-time drilling monitor (RTDM) workstation provides real-time information at a well-site. The workstation may include a display and a processor coupled to the display. The processor receives sensor signals from a plurality of sensors and generates a single graphical user interface (GUI) populated with dynamically generated parameters based on the sensor signals, as well as static information and dynamically updated uncertainty assessments.

20 Claims, 11 Drawing Sheets

GEOLOGICAL MONITORING CONSOLE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

Drilling a well (e.g., oil, gas) is a complex, time-consuming, and expensive endeavor. Often, experts such as geologists manually collect the results of seismic studies, data from other wells drilled near the target location, and other information. From such data, the geologist generates a geological model of the various formations below the surface of the drilling rig. The geological model also includes depths to the various "tops" that define the formations. The term "top" generally refers to the top of a horizon, a fault, stratigraphic or biostratigraphic boundaries of significance pore pressure transition zones, etc. A typical geological model includes multiple tops defining the presence and geometry of such subsurface features, as well as the composition of such subsurface features.

A "well plan" is developed based, at least in part, on the geological model. The well plan specifies a number of parameters for drilling the target well such as the mud weight, drill bit rotational speed, and weight-on-bit (WOB). The workers on the drilling rig control the operation of the drill bit commensurate with the well plan. For example, the rig workers may want to reduce the rate of penetration (ROP) in a harder rock formation to prevent damage to the cutters on the drill bit. Thus, the rig workers typically rely on the well plan to anticipate tops and drilling uncertainties, and adjust drilling parameters accordingly; without the well plan, the rig workers would not know the location of the various tops and associated drilling uncertainties.

Oftentimes, the initial geological model is not completely accurate. For example, the actual distance from the surface to a particular top might be different than the estimated distance in the initial well plan by a number of feet. Most geological models recite distances from the surface down to a particular top, the distance between two subsurface tops, or combinations thereof. Thus, if the location of a particular top in the well plan turns out to be inaccurate, that error may have an effect for all other tops whose locations are specified relative to the former top. Such inaccuracies in the geological model impact the well plan and inhibit the ability of the rig workers to anticipate tops and drilling uncertainties.

Drill strings and surface equipment include numerous sensors and devices that monitor a wide variety of parameters such as hole depth, bit depth, mud weight, choke pressure, etc. Such information can be used to determine the accuracy of the initial well geological model. However, the data generated in real-time during drilling operations is voluminous, and in many cases, personnel on the drilling rig are not equipped and/or may not have the time to review and interpret the vast quantity of collected data at the well site. Instead, some of the monitored data can be transmitted back to the geologist at a remote site for further analysis and interpretation. Because the rig can be in a remote location (e.g., off shore) the communication link for such transmissions usually involves satellite communications which may not have sufficient bandwidth to transmit the vast quantity of information being acquired at the well site. Due, at least in part, to the bandwidth limitations, some, but not all, of the acquired sensor data is transmitted back to the geologist at the remote location. For example, a particular sensor may take a sample reading every one-half second but only every fifth of those readings (representing one reading every 2.5 seconds) is actually transmitted back to the geologist. As a result, the geologist may miss crucial information because he/she is provided less than all of the data. Further, even if all sensor data from the well site could be transmitted back to the geologist, it may take a significant amount of time for the geologist to interpret the information, update the geological model and well plan and transmit the updated plan back to the well site. However, due to the cost and time sensitive nature of drilling, drilling operations continue while the rig workers await the updated well plan from the geologist. Drilling continues in the face of potentially inaccurate information due to the lengthy time lag as the well plan is updated and communicated back the rig.

BRIEF SUMMARY OF THE DISCLOSURE

Embodiments described herein include a combination of features and advantages intended to address various shortcomings associated with certain prior devices, systems, and methods. The various characteristics described above, as well as other features, will be readily apparent to those skilled in the art upon reading the following detailed description, and by referring to the accompanying drawings.

A real-time drilling monitor (RTDM) workstation is disclosed herein for providing real-time information at the well-site itself. In some embodiments, the workstation includes one or more displays and a processor coupled to the display. The processor receives sensor signals from a plurality of sensors and generates a single graphical user interface (GUI) populated with dynamically generated parameters based on the sensor signals, as well as static information and dynamically updated uncertainty assessments.

Other embodiments are directed to a method including receiving a well plan at a workstation on a drilling rig and receiving sensor signals in real-time from sensors associated with the drilling rig. The method may also include generating updated drilling information based on the sensor signals, updating uncertainty assessments of a drilling operation, and displaying the updated drilling information and uncertainty assessments on a display screen at or accessible to the workstation.

The workstation provides a single cohesive GUI on which considerable real-time data, computed values, status and other information is provided. The workstation avoids having to rely as much on remote personnel to receive and interpret the data and provide drilling instructions back to the well site. Additionally, because a great deal of the data is acquired, processed, and displayed locally at the well site itself, the workstation reduces the demand on bandwidth to remote sites for data analysis and interpretation.

BRIEF DESCRIPTION OF THE DRAWINGS

For a detailed description of exemplary embodiments of the disclosure, reference will now be made to the accompanying drawings in which.

DETAILED DESCRIPTION

Figure 1:
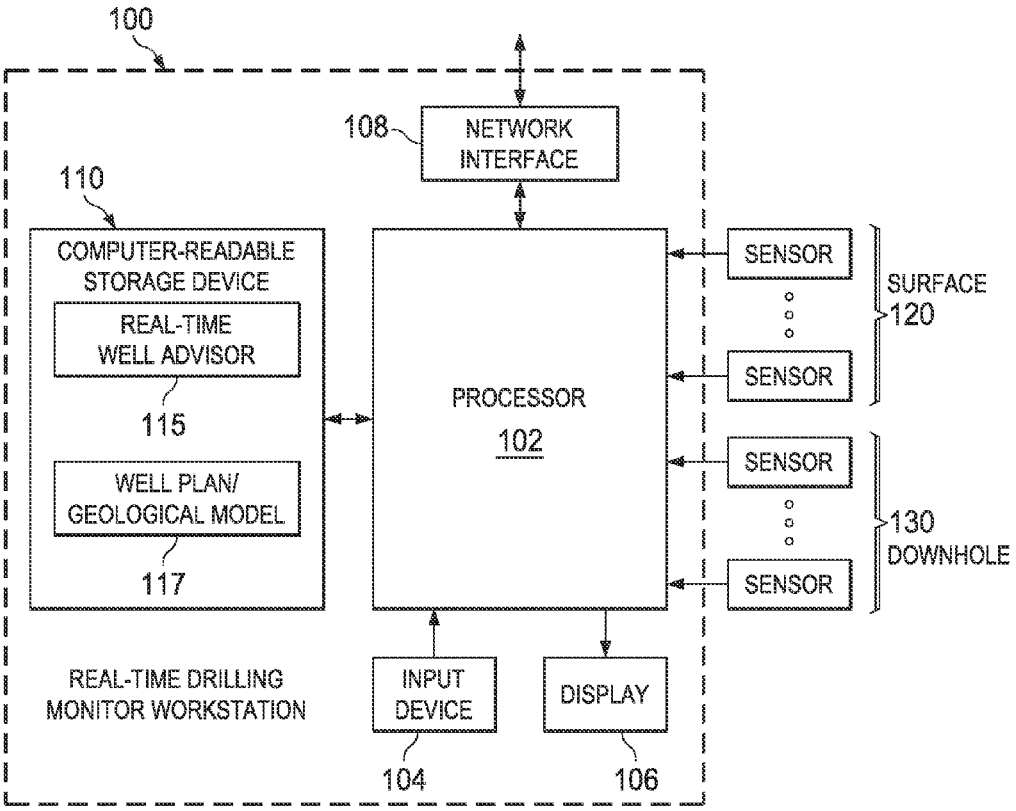
FIG. 1 illustrates a real-time drilling monitor workstation in accordance with various embodiments.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment.

Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection can be through a direct connection, or through an indirect connection via other devices, components, and connections.

FIG. 1 illustrates a real-time drilling monitor (RTDM) workstation 100 in accordance with various embodiments. As shown, the RTDM workstation 100 is coupled to various sensors 120 and 130. The RTDM workstation 100 includes a computing system resident at a well site. As an overview, the RTDM workstation 100 collects real-time sensor data sampled during drilling operations, processes the data locally at the well-site, and provides nearly instantaneous visual feedback in the form of a single unified graphical user interface (GUI) such as the GUI 320 shown in FIG. 11 and described below. The single GUI is populated with dynamically updated information, static information, and uncertainty assessments. The GUI may be populated with other types of information (e.g., as described below) as well. Personnel are thus able to glean a substantial amount of information about the status of the drilling operation in one view. The RTDM workstation 100 reduces the need to transmit data to a remote site for processing away from the well site. In addition, the RTDM workstation 100 can be used to readily compare an initial well plan to real-time data to determine whether the tops, formations, events, and uncertainties encountered during drilling have varied from the initial plan.

The RTDM workstation 100 can be implemented as a single computer system, multiple computers, a server, a handheld computing device, or any other type of computing system. The workstation 100 is used at a well site such as on an offshore drilling platform or land-based drilling rig. The architecture of the RTDM workstation 100 in FIG. 1 is only one example of multiple possible architectures. In the example of FIG. 1, the workstation 100 includes one or more processors 102 coupled to an input device (e.g., a mouse, a keyboard, etc.) 104, an output device such as a display 106, a network interface 108, and a non-transitory computer-readable storage device (CRSD) 110. In some embodiments, the input device 104 and output device 106 are part of the workstation itself, while in other embodiments; the input device 104 and output device 106 are accessible to the workstation via a network or other type of connection.

The network interface 108 can include a wired-based interface (e.g., Ethernet) or a wireless interface (IEEE 802.11x ("WiFi"), BlueTooth®, wireless broadband, etc.) and generally provides network connectivity to the workstation 100 to enable communications across local and/or wide area networks. Via the network interface 108, for example, the workstation 100 can receive portions of or entire well plans and geological models from remote locations. For example, a geologist or other personnel can initiate transmission of a digital file that specifies a particular well plan and some of the geological model on which the well plan was developed to the workstation 100 at an off-shore drilling platform.

The CRSD 110 includes non-volatile storage devices such as a hard disk drive, Flash memory, etc. The CRSD 110 may include volatile storage devices such as random access memory (RAM), or combinations of volatile and non-volatile storage devices. The CRSD 110 stores Real-Time Well Advisor (RTWA) software 115 which is executable by the processor 102. Execution of RTWA software 115 by the processor 102 performs some or all of the functionality described herein. The CRSD 110 can also store the well plan and geological model data (117).

In some embodiments, the RTWA software 115 is a web-enabled application. As a web-enabled application, access to the RTWA software 115 is possible over a network connection such as the Internet. For example, a remote user can access the RTWA software 115 via the user's own web browser. In some embodiments, the RTWA 115 performs all of the computations and processing described herein and only screen pixel data is transmitted to the remote browser for rendering the screen shots on the remote browser's computer. In other embodiments, the remote browser or other software on the remote system performs some of the functionality described herein.

FIG. 1 also shows sensors 120 and 130 which are coupled to the processor 102 of the RTDM workstation 100. The sensors 120 and 130 can be connected directly to the RTDM workstation 100 or through intermediate devices, switches, networks and the like. Sensors 120 include one or more surface sensors and sensors 130 can include one or more downhole sensors. Examples of surface sensors 120 include torque, revolutions per minute (RPM), and weight on bit (WOB) sensors. Examples of downhole sensors 130 can include gamma ray, pressure while drilling (PWD), and resistivity sensors. Collectively, surface and downhole sensors 120 and 130 are sampled by the RTDM workstation 100 during drilling operations and provide considerable information about the health and status of the drill bit, bore hole, and formations in which the drill bit is located. Based on the readings from the sensors 120 and 130, one or more or all of the following illustrative list of parameters is provided to the RTDM workstation 100:

| Surface Parameters | Downhole Parameters |
|---|---|
| Block position/height | All FEMWD |
| Trip/running speed | Bit depth |
| Bit depth | Hole depth |
| Hole depth | PWD annular pressure |
| Lag depth | PWD internal pressure |
| Gas total | PWD EMW |
| Lithography percentage | PWD pumps off min, max and average |
| Weight on bit | Drill string vibration |
| Hook load | Drilling dynamics |
| Choke pressure | Pump rate |
| Stand pipe pressure | Pump pressure |
| Surface torque | Slurry density |
| Surface rotary | Cumulative volume pumped |
| Mud motor speed | Data from Leak Off Tests (LOT) and Formation Integrity Test (FIT) |
| Flow in and flow out | |
| Mud weight | |
| Rate of penetration | |
| Pump rate | |
| Cumulative stroke count | |
| Active mud system total | |
| Active mud system change | |
| All trip tanks | |
| Mud temperature in/out | |

Based on at least some of the preceding parameters, the RTWA software 115 causes the processor 102 to calculate other parameters. The following is an illustrative list of the parameters calculated by the RTDM workstation 100 based on the sensed parameters:

| Calculated Parameters |
|---|
| In slips/connection time |
| Connection drag |
| Washout/restriction ratio where available |
| Total hours on bit |
| Calculated bottom up strokes |
| Calculated in/out strokes |
| Total bit revolutions |
| Drilling Exponent (Dxc) |
| Calculated hydraulics |

Prior to commencement of drilling, an expert (e.g., a geologist) generates a well plan. The well plan can be generated in a variety of ways such as based on seismic studies performed in the area around the target well, data collected from other wells in the area, and the general experience of the expert. The well plan is based on a geological model that identifies the various formations anticipated as being located below the surface of the ground, the type of rock and various geological parameters associated with such rock, and the distances to each formation. Each distance can be specified in terms of distance from the surface to the top of the formation or distance from another formation top. For the latter relative distance between tops, an error in the location of one top will cause the plan to be inaccurate in terms of the other tops that were specified relative to that top.

The well plan may specify a number of parameters such WOB, mud weight, drill bit rotational speed, etc. The well plan can also specify one or more "uncertainties" anticipated to be encountered during drilling. An uncertainty indicates the likelihood that some aspect of the well plan or the geological model on which the well plan is based will turn out to be different than what is ultimately actually encountered during drilling operations. For example, an uncertainty can indicate that a particular top predicted to be present in the geological model is not actually present when the well is drilled, or that the location of the top turns out to be at a different depth than initially thought, or that the thickness or composition of the top is different than initially expected.

One or more aspects of the well plan and geological model can be entered into a computer (possibly but not necessarily the RTDM workstation 100) in any desired format understood by the software 115. The well plan is transmitted to the RTDM workstation 100 via the network interface 108, or entered manually into the workstation via the input device 104.

Drilling operations are generally performed, at least in part, on the basis of the well plan. As noted previously, for example, the drill bit rotation can be slowed down as the drill bit reaches a particular depth where a certain type of rock formation (e.g., harder rock) is expected to exist. It is thus beneficial to the personnel at the well site to have a well plan that accurately reflects the actual subsurface structures encountered during drilling.

The plan, however, can have inaccuracies that are determined, using the RTDM workstation 100, during drilling. In general, the RTDM workstation 100, running RTWA software 115, collects and processes the sensors' data, calculates various parameters and provides considerable information about real-time drilling operations in the form of a unified graphical user interface (GUI). A unified GUI is a single graphical window in which information is displayed. Most or all of the information needed by the drilling personnel on the rig is readily available on the GUI, thereby reducing or eliminating the heavy reliance on remote personnel to receive and process data from the rig.

The RTWA software 115 integrates both subsurface data and surface metadata (e.g., comments about well events and offset well analysis) to provide a complete and visual understanding of the wellbore and pre-identified uncertainties. The software also correlates the horizons, zones, uncertainties, non-productive time (NPT) events, annotations, and any other relevant information in the current well being drilled with the original well plan and with offset wells in the area. Further, the RTWA software 115 provides the ability to track, focus and present NPT information in a clear and readily understood manner in real-time. In this context, real-time means sufficiently quickly as to show results generally as they are occurring. The RTWA software 115 also enables the user to share information about the drilling data in real-time with others around the world thereby to rely less on an otherwise larger workforce. Remote users may be provided access to the RTWA software 115 by a pre-assigned credential such as a user name and password. Real-time decision making and reactive input at the well site is thus made possible by providing a RTDR workstation 100 with RTWA software 115 that provides real-time well status, alerts, warnings, and uncertainty updates.

Figure 2:
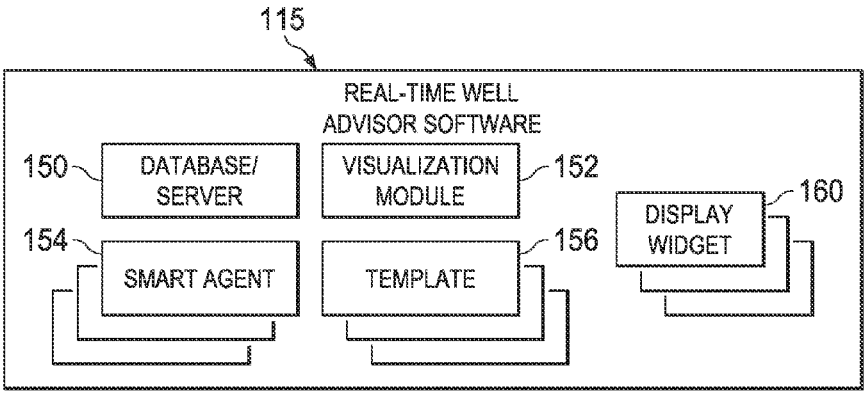
FIG. 2 illustrates a software architecture in accordance with various embodiments.

FIG. 2 illustrates an illustrative architecture of the RTWA software 115 in accordance with illustrative embodiments. In the example of FIG. 2, the RTWA software 115 includes a database/server 150, a visualization module 152, one or more smart agents 154, one or more templates 156, and one or more display widgets 160. The database/server 150 aggregates, distributes, and manages real-time data being generated on the rig such as by the sensors 120, 130. The visualization module 152 implements a graphical user interface (GUI), also called a "console," on the display 106, and in some embodiments is a browser-based application. The information shown on the console includes, for example, raw data and calculated data in real-time.

One or more templates 156 can be selected or created by the user to display information in the console generated by the visualization module 152. A template defines a visual layout of the GUI (e.g., GUI 320 in FIG. 11). In some embodiments, a template is an XML file. Each template 156 can be populated with any of a variety of information. For example, the template can be populated with a combination of raw sensor data, processed sensor data, calculated data values based on sensor data and other information, graphs, text, etc. Some information may be static while other information may dynamically updated during drilling operations. Each template 156 within the console is built by combining various display widgets 160 which present data or other information related to, for example, geologic uncertainty. The templates 156 can display raw data from multiple sources on the rig, calculated data, and/or results from third party applications. Each smart agent 154 performs calculations based on data generated by one or more of the various sensors 120 and 130. Such calculated data can be displayed via a corresponding display widget 160.

The following is a non-exhaustive list of previously unknown display widgets 160. Each display widget 160 is detailed below. Some display widgets are populated with information computed by a smart agent and such smart agent usage is identified in the discussions below of the various display widgets. The user can also create and customize their own display widgets 160 as well as smart agents.

Correlation Widget
Gas Widget
Normalized Gas Widget
Mud Weight (MW) Widget
Operational Time Depth Plot Widget
Zone Widget
Prognosis Widget
3D Overview Widget
Basic Geosteering Widget
Time-Depth Trend Widget
Velocity Conversion Widget Correlation Widget The correlation widget correlates between Logging While Drilling (LWD) or wireline curves from the active well with one more offset wells. This widget displays a plurality of "tracks." Each track includes a dedicated display area in which information can be rendered. The information displayed by the correlation widget includes two depth tracks for each well (e.g., measured depth (MD) and true vertical depth (TVD)) and two additional tracks for curves (e.g., gamma ray, resistivity, total gas) for each well. The active wellbore also contains a well schematic/bottom hole assembly (BHA) track, a lithography track, and a core track if cores are taken. Drilling personnel may photograph a core. An icon representing the photographed core can be displayed on the GUI at the depth corresponding to where the core was taken. A user can select (e.g., by clicking) the photograph for viewing on the GUI. The correlation widget can display information pertaining to any suitable number of wells (e.g., 6).

Figure 3:
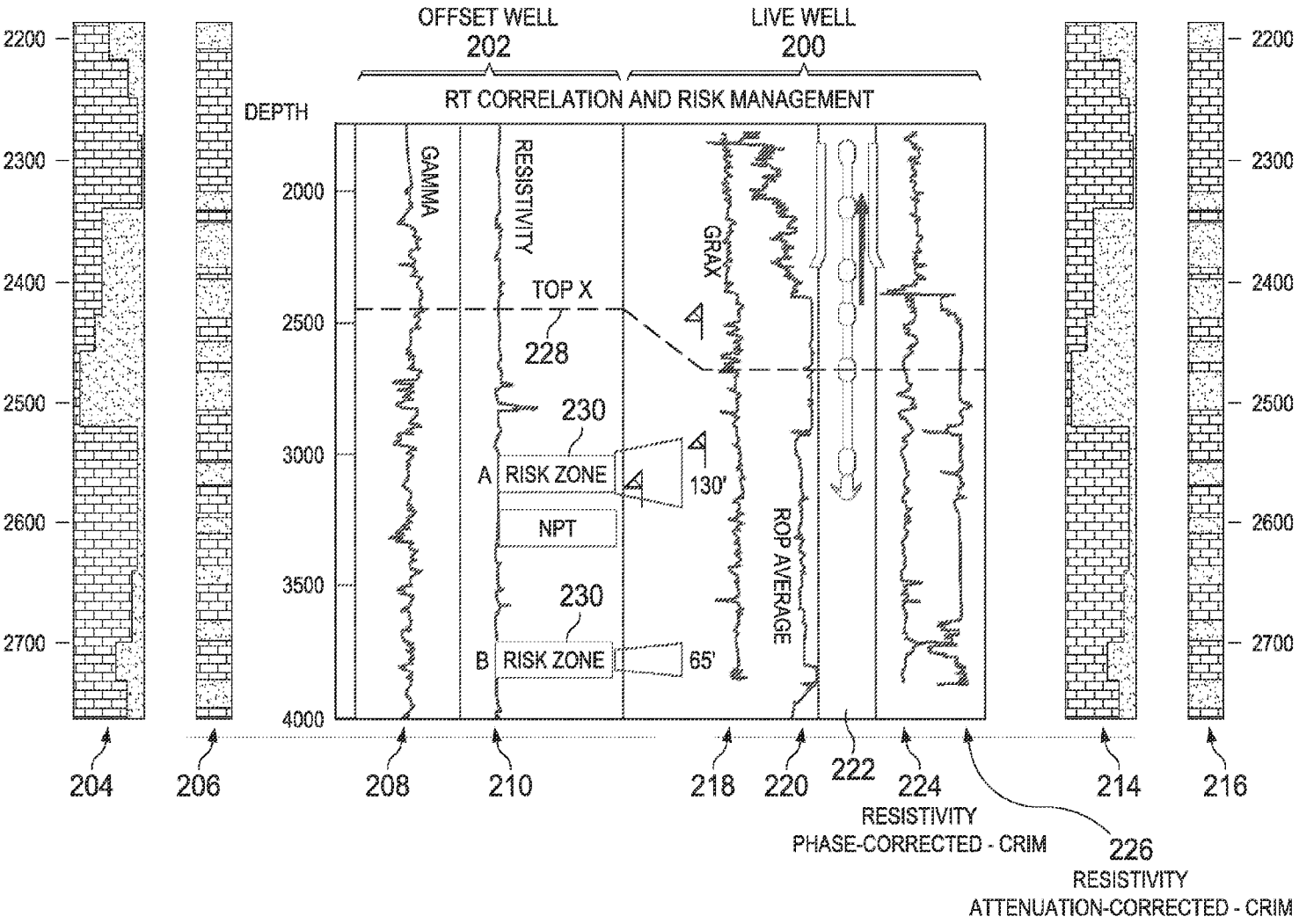
FIG. 3 illustrates a graphic produced by a correlation widget in accordance with various embodiments.

FIG. 3 shows an exemplary display using the correlation widget. Information about the active wellbore (labeled as "live" well in the example of FIG. 3) is shown at 200 and information about an offset well is shown at 202. Two depth tracks 204 and 206 (e.g., MD and TVD) are shown for the offset well 202, and two depth tracks 214 and 216 (e.g., MD and TVD) are shown for the active wellbore 200. The offset well 202 further includes two tracks 208 and 210 in which curves can be rendered. Curves such as stand pipe pressure, D exponent, and mechanical specific energy can be rendered in tracks 208, 210. The active wellbore 200 includes tracks 218-226. Various curves (e.g., gamma ray, resistivity, total gas, etc.) can be included in tracks 218, 220, 224, and 226 while track 222 includes rendering of the BHA. The BHA rendering is dynamically updated to show the current location of the BHA. At least some of the curves for the active wellbore 200 are of the same type as for the offset well thereby enabling correlation between same type curves.

The correlation widget performs or enables various types of correlation. For instance, the user can choose a curve (e.g., by right clicking on each such curve within a track 208-226) in each well and the widget runs a cross-correlation to obtain an estimate of the depth shift between the two selected curves. The widget prompts the user to input a depth range as an input parameter for the cross correlation calculation. The correlation widget then displays a plot of the resulting cross-correlation and provides the user with an option to accept, modify, or reject the depth offset that was used in the calculation.

Alternatively or additionally, the correlation widget permits the user to select a horizon or marker on each well and link them together as a correlated event. Once horizons or events are correlated they will be joined by a line to visually demonstrate their structural relationship to each other. Various calculations on the delta between the two wells can be displayed as desired.

The correlation widget also permits the user to select a single curve from the active wellbore and to perform a visual correlation by sliding the disengaged curve over the offset well curve of the same type. For example, a user can click (e.g., right click) on one curve and drag that curve (or a copy of the curve) over so as to be displayed generally on top of another curve for easy visualization and comparison of the two curves. Once the user is finished with the visual comparison, the mouse button can be released and the initial curve that was moved reverts back to its initial location in the GUI. When a satisfactory correlation is determined, the user chooses the correlation depth and the widget displays the correlation depth shift and links a correlated event between the wells.

Once a marker is correlated between the offset well and active wellbore, the user will have the option to "flatten" the display. Flattening the display entails vertically shifting the offset log display so that an event in the offset log lines up with the corresponding event in the active well. Any correlations can be visually identified by the widget drawing a line between the correlated depths in the offset well and the active well. FIG. 3 illustrates a correlation line 228 between a corresponding top on the offset and active wells. The line is somewhat disjointed (i.e., not completely horizontal) thereby indicating that the top turned out to be at a depth different from that in the offset well.

The correlation widget can also display zones that have an associated uncertainty in both the offset and active wells. For each uncertainty event, the correlation widget stores one or more of the following, which are not intended to be limiting:

Type of Uncertainty
Well name associated with the uncertainty
Depth Associated with the uncertainty Depth Error bar associated with the uncertainty
Text Description of the uncertainty
Link to full report describing the uncertainty (or to Uncertainty Management application)
Depth Mapping for expected depth and error bar from offset well to active well (for uncertainties associated with offset wells)

The user has the option to enter or edit any of the uncertainties using the correlation widget. The uncertainties will be displayed in an "uncertainty track". Several uncertainties are illustrated in FIG. 3 at 230. Correlations between associated uncertainties in different wells can be shown using correlation lines linking the uncertainties.

The active wellbore also includes, as shown in track 222 of FIG. 3, a wellbore schematic showing the hole size in open hole and the casing in the well. In at least some embodiments, the rendered color of the annulus is colored outside of all upsets on the drillstring and BHA. The color should be based on the distance (tolerance) between the diameter of the upset and the diameter of the borehole wall or casing. In some embodiments, tight tolerances (e.g., tolerances less than a user-configurable dimension) are rendered in red or other suitable color, while all other tolerances are rendered in green or other suitable color. Further still, three or more colors can be used to indicate various levels of tolerances between the upsets and the borehole wall or casing such as green, yellow and red.

The user has the option to playback previously acquired and recorded data in the correlation widget in order to understand the interaction between the drillstring/BHA/centralizers and the wellbore. During playback some or all of the information depicted in the GUI is cleared and the previously acquired data and processed values are repopulated in the GUI to show the user what has happened thus far in the drilling operation. Depth indexed curves also can be played back with the BHA location changing to match the depth it was located while the measurement was recorded (normally during drilling). In a certain playback mode, the depth indexed curves will not change. Instead, the BHA will move to the location based on clock time. The correlation widget is also linked to time-indexed log widgets, so that as the BHA moves, the user can see the response on time-indexed curves in other widgets.

The user can export an uncertainty listing with associated depths. The uncertainty listing can be exported as an ASCII file, a spreadsheet, an XML file, etc. The uncertainties can be displayed by group, and in accordance with illustrative embodiments, such possible groupings can include:

All uncertainties
Drilling uncertainties
Gains and Losses uncertainties
Well Bore Stability (WBS) uncertainties
Geologic uncertainties The correlation widget also permits a user to input mudlogs from an external mudlog authoring package or input mudlogs from the field. The user has the ability to toggle between multiple mudlogs that are stored for the same well. Using the interface to the correlation widget, the user can toggle between interpreted lithology and mudlogged lithology.

Gas Widget

Figure 4:
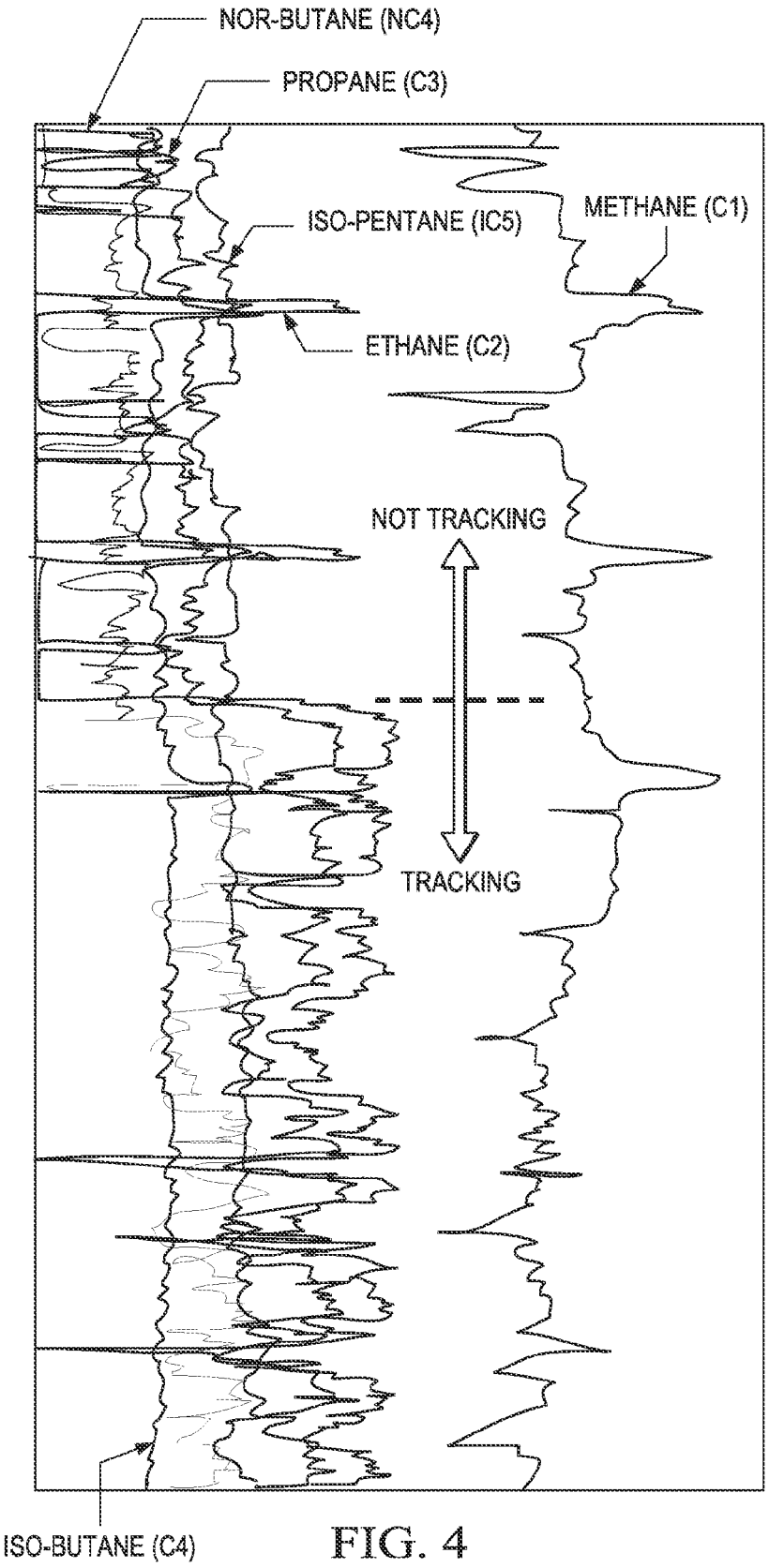
FIG. 4 illustrates a graphic produced by a gas widget in accordance with various embodiments.

The gas widget includes a display on a logarithmic scale of a depth-indexed log showing the gas relationships. This is a widget whose input data is fed with smart agent calculations. This widget is used to identify the types of gas and the associated drilling depth of gas in the drilling mud. FIG. 4 shows an example of a display generated by the gas widget. The illustrative display shows curves for methane (C1), ethane (C2), propane (C3), iso-butane (C4), nor-butane (NC4), iso-pentane (IC5). Such curves can represent such gasses in units of parts per million (PPM) over time or depth as selected by the user. The user of the RTWA software 115 can select the particular gasses to be displayed as well as select from one or more equations whose output values are displayed in graphical form as seen in FIG. 4. The graphs in FIG. 4 are dynamically updated during drilling operations and may represent the quantity of the user-specified gas or the result of an equation using a particular gas with respect to time or depth as selected by the user. The gas widget is useful to determine, for example, the presence of gas in the mud which is an early indicator of formation fluid influx.

Normalized Gas Widget

Figure 5:
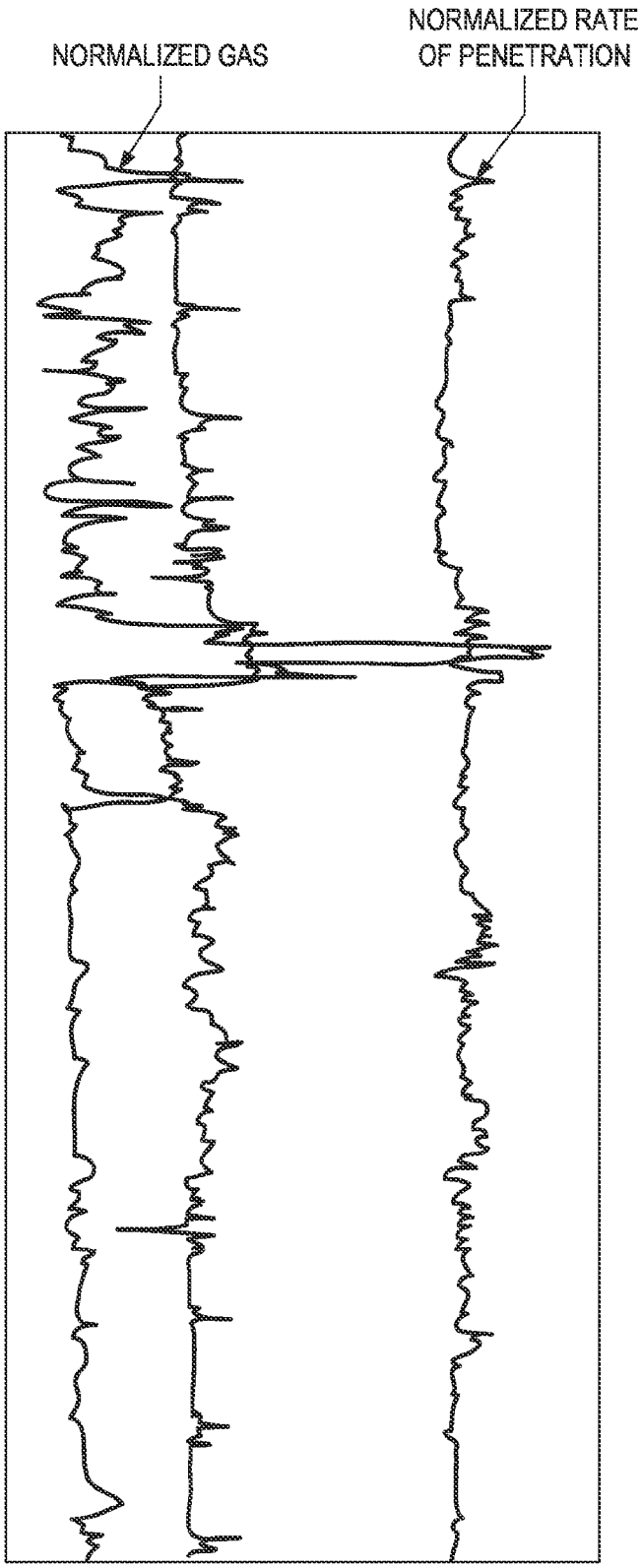
FIG. 5 illustrates a graphic produced by a normalized gas widget in accordance with various embodiments.

The normalized gas widget display is used to show the total gas normalized for rate of penetration. This widget divides total gas by well bore diameter, penetration rate, and weight on bit (WOB). The normalization is performed by a smart agent 154. Increased gas can be associated with faster rate of penetration. FIG. 5 shows an example of a display generated by the normalized gas widget and shows normalized total gas and normalized ROP. As with the gas widget described above, the graphs in FIG. 5 are dynamically updated during drilling operation and are based on a user-specified gas or gas equation.

Mud Weight (MW) Widget

Figure 6:
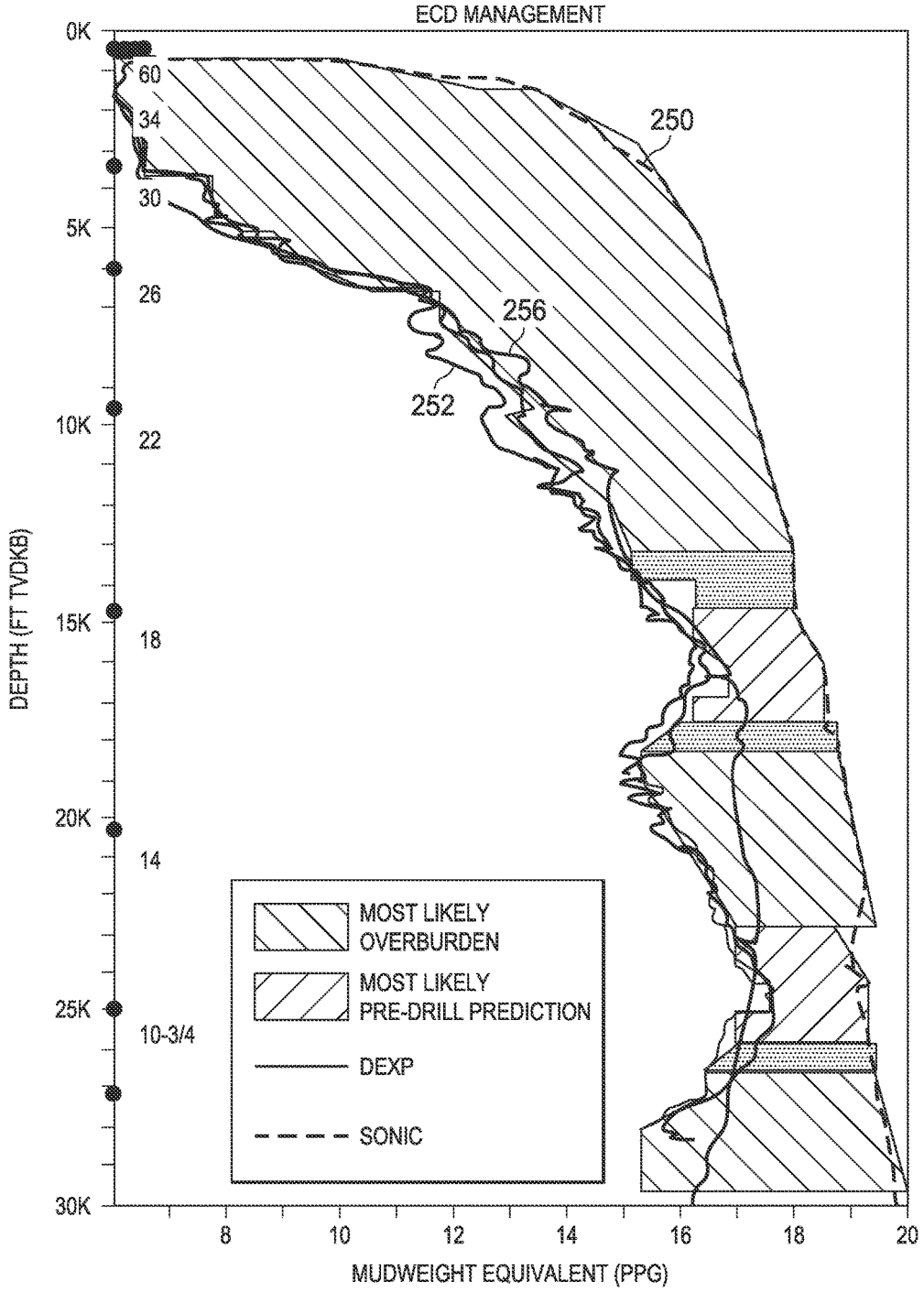
FIG. 6 illustrates a graphic produced by a mud weight widget in accordance with various embodiments.

The mud weight widget shows the minimum and maximum acceptable mud weights plotted versus depth. In open hole sections, the mud weight should be high enough to contain the formation fluids but low enough not to fracture the formation for all formations within the open hole. FIG. 6 shows an example of a display produced by the MW widget. Curve 250 depicts the maximum acceptable mud weight at each depth and curve 252 depicts the minimum acceptable mud weight at each depth.

The display can show various continuous curves such as Equivalent Circulating Density (ECD) versus depth (changing with time) (not specifically shown in the example of FIG. 6), the predicted pore pressure versus depth 256, and the predicted fracture gradient versus depth (also not specifically shown in the example of FIG. 6). ECD is calculated in a smart agent 154 and presented over the entire openhole section (varying with time).

In at least some embodiments, the area between the current ECD and the pore pressure is colored based on the delta between the two over the entire open hole section. Similarly, the area between the current ECD and the fracture gradient is colored based on the delta between the two over the entire open hole section. The MW widget also allows the user to display predrill curves from multiple sources for comparison.

Operational Time Depth Plot Widget

Figure 7:
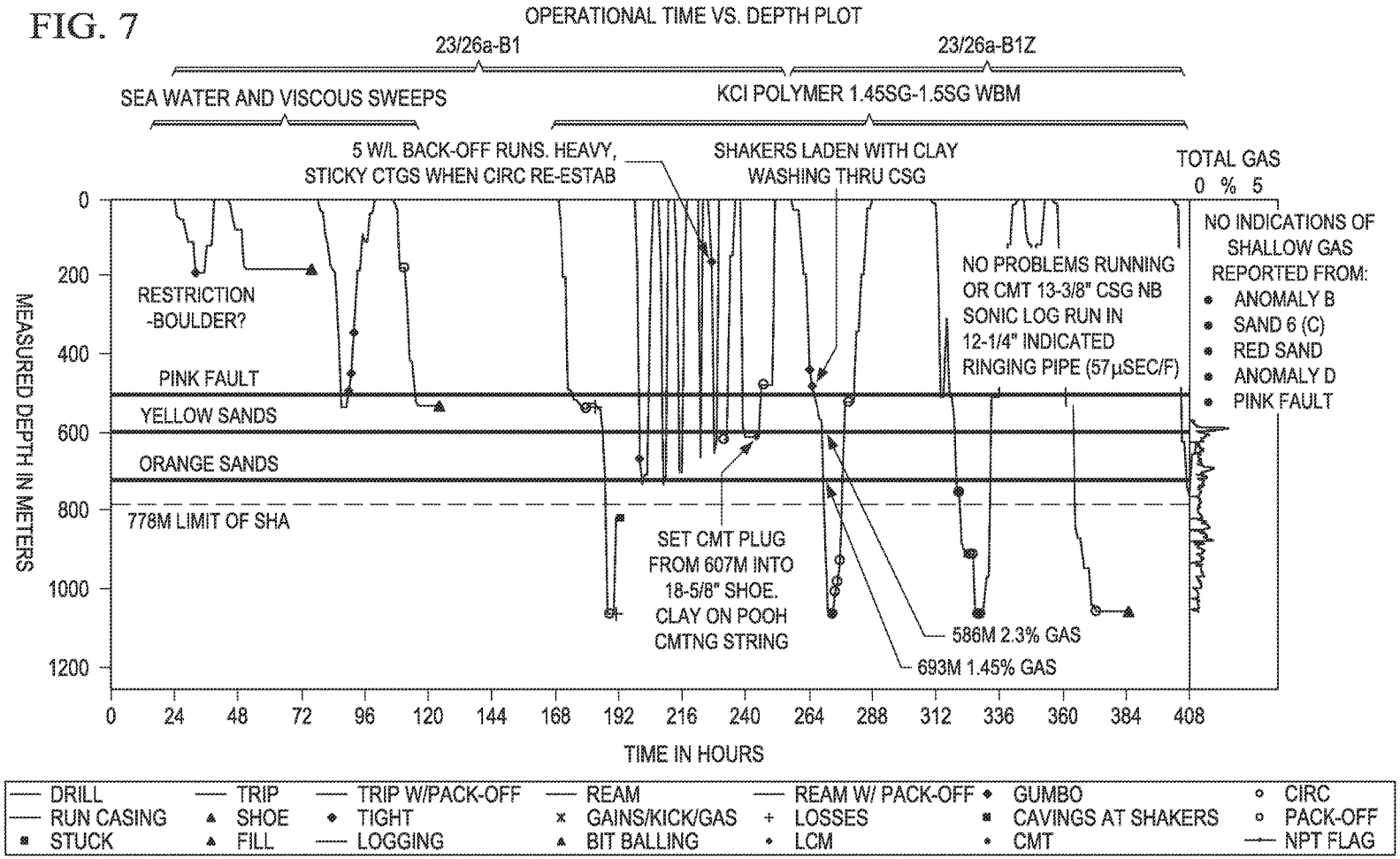
FIG. 7 illustrates a graphic produced by an operational time-depth plot widget.

FIG. 7 shows an example output of the operational time depth plot widget. The plot is a cross-plot of bit depth versus clock time. The displayed output provides a summary of some or all tripping activity that has occurred in the well from spud until completion. The horizontal axis is clock time and the vertical axis is bit depth. This plot provides a history of the trips made into the well from the start of the well.

This widget permits a user to add an additional vertical axis (with user defined scales) and display additional curves versus clock time. Examples of additional curves and vertical axes which the user can select include projected pressure or mud weight to the bit. A smart agent 154 can be used to calculate the projected data and store it as a curve. The operational time depth plot widget can be linked to such calculated data.

The operational time depth plot widget permits a user to modify both the time and depth scales and to scroll along the horizontal (time) axis. The operational time depth plot widget also permits a user to choose a curve and then the widget determines an associated trend line for the curve, that is, a line or curve that best fits the data according to a specified criterion. The user can make this selection in one of two ways. First, the user can choose a curve and then choose a start point and an endpoint for a linear trend line. Alternatively, the user can choose a curve, a time range, and then request one of a number of curve fitting options such as linear, first degree polynomial approximation, second degree polynomial approximation, cubic spline, cosine, etc.

Along with the bit depth curve, the operational time depth plot widget also displays uncertainty flags associated with uncertainties identified in both the active and offset wells. This widget also displays user-entered annotations associated with the well. Flags can be colored based on the source of the information: uncertainty associated with active well, uncertainty associated with offset well, annotation from driller, annotation from operations geologist, and annotations from other domain experts. The user can also toggle the display of the flags on and off. Further, the user can configure the widget to display the annotations as a flag or display the annotations themselves on the screen.

The color of the time-depth plot can be any suitable color and can be based on the rig activity at that time (e.g., drilling, circulating, etc.). The user can cause the time-depth plot to be displayed only during certain chosen activity codes.

Further, this widget permits the user to be able to zoom in and out on both scales and do so simultaneously by "rubber banding" over the area to be displayed. Rubber banding enables the user to drag a rectangle around a graph area to display only the graph elements that are visible within or touching the rectangle. As a result, only a subset of the elements from the current graph is shown. The user also can print the area displayed after zooming. If, using a mouse or other pointing device, the cursor is hovered over a flag, information related to that particular uncertainty or annotation is displayed until the cursor is moved. The widget will link to a full report associated with a selected uncertainty upon the user selecting the uncertainty and selecting a full report option. The widget will also export the depth, rig activity, annotations, and uncertainties versus depth to various output file types such as ASCII, spreadsheets, XML, etc. Headings are created by the widget when printing the cross plot. The headings include rig name, well name, and other information. Finally, the user has the option to enter comments that are associated with a specific time of the operation, a specific depth, or both. In addition to the comments, the user is able to tie links to more lengthy commentary in an external location.

Zone Widget

Figure 8:
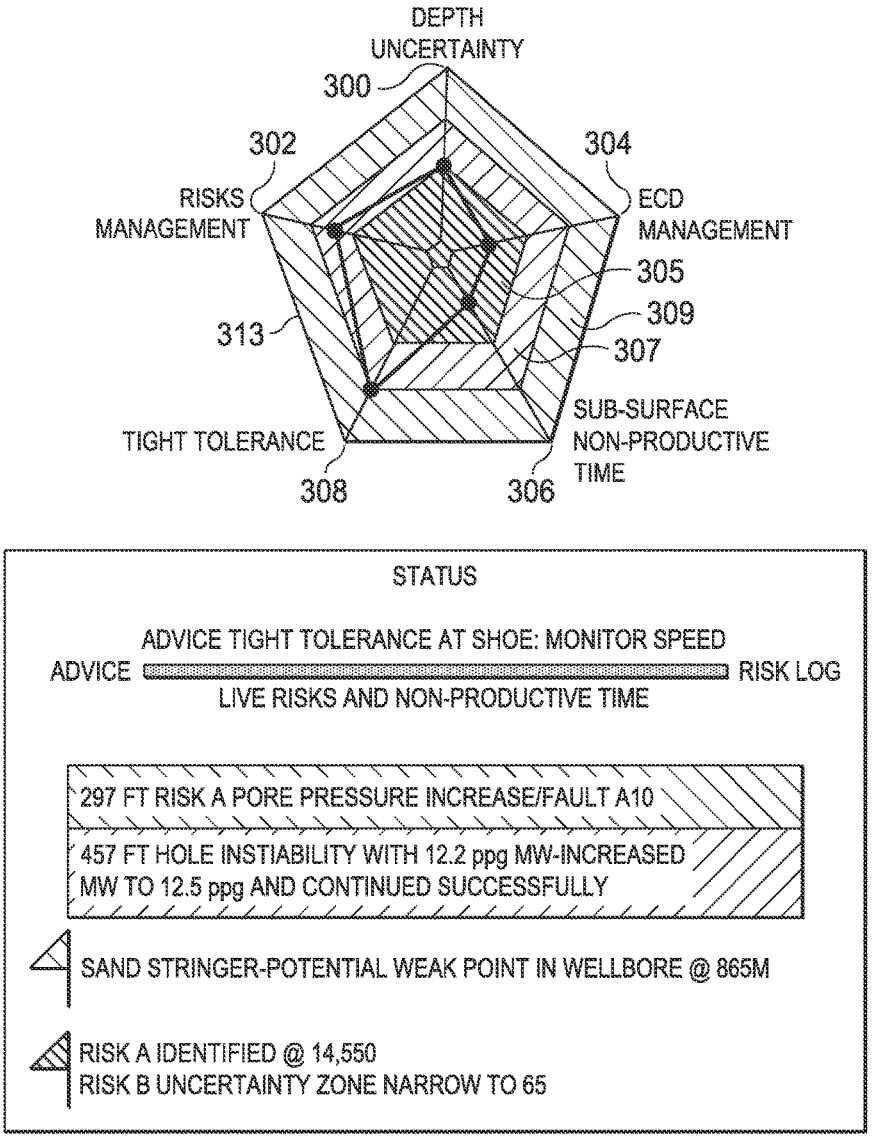
FIG. 8 illustrates a graphic produced by a zone widget in accordance with various embodiments.

The zone widget produces a graphic such as that shown in FIG. 8. The illustrative graphical output of FIG. 8 is shown as a pentagon. Each of the five vertices represents a different type of uncertainty. The uncertainty types in the example of FIG. 8 include depth uncertainty (vertex 300), uncertainty (risk) management (vertex 302), ECD management (vertex 304), sub-surface non-productive time (SS NPT) (vertex 306), and tight tolerances (vertex 308). The depth uncertainty indicates the uncertainty as to the actual MD or TVD of any given point in the wellbore of the actual well. The management uncertainty indicates the number of uncertainties ahead of the current depth and in the current open hole as well as the well plan's ability to predict the current well conditions. The SS NPT indicates uncertainties related to connection gas, flowback and gas ration analysis. The ECD management uncertainty indicates the drilling window that exists and provides a graphical representation of where the margin increases or decreases. This should exist for the entire open hole section and vary depending on lithologies drilled and new estimation of pore pressure and fracture gradients. The tight tolerance uncertainty vertex 308 indicates, for example, the number of locations along the drill string that is at a tight tolerance level (less than a user defined threshold as noted above) or the percentage of the drill string that is within the thresholds defined as "tight". Each of the five uncertainty vertices has a variably assigned color or gray scale depending on the current state of each such uncertainty. In the example of FIG. 5, each uncertainty vertex can be assigned one of three different values/colors 305, 307, and 309 representing low, medium and high uncertainty, respectively. Other embodiments implement a different number of uncertainty levels and, for that matter a number of uncertainties different than five. The shaded area 313 provides an indication of the current level of each of the five uncertainties depicted in the example of FIG. 5. As can be seen, for example, the shaded region 313 has reached the outer uncertainty level 309 for the tight tolerance uncertainty 308 thereby indicating a high uncertainty level for that particular uncertainty. Shaded region 313, however, is within inner uncertainty level 305 for the ECD uncertainty vertex 305 thereby indicating a low level for ECD uncertainty. Overall, the zone widget provides the user a quick assessment to determine if there is an upcoming uncertainty associated with geologic uncertainty.

Each of the various performance indicators can be rendered in various colors. Red can be used to indicate a warning or alarm situation. A short comment can be displayed by this widget to indicate the cause of the warning or alarm.

File Widget

Figure 9:
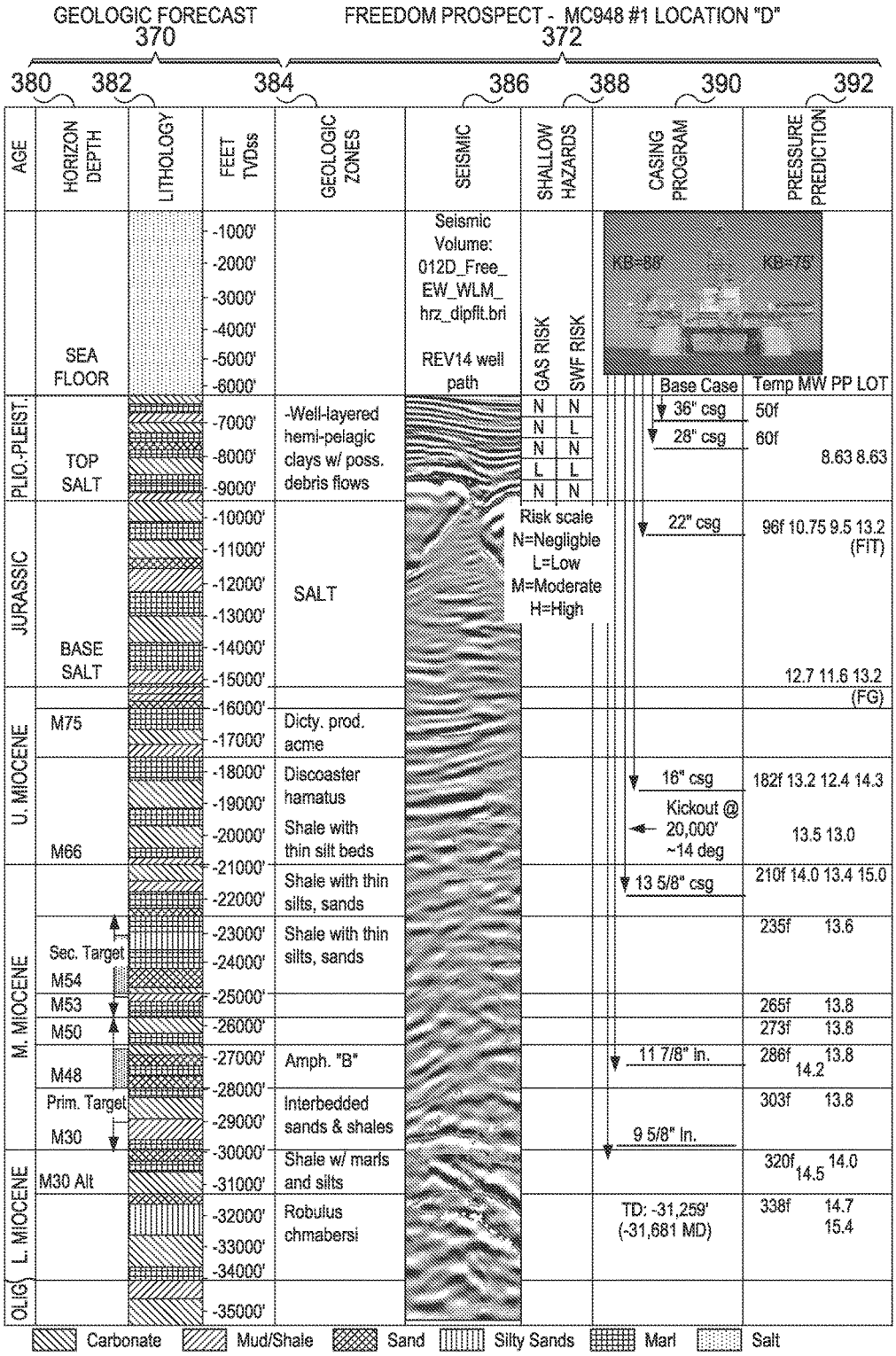
FIG. 9 illustrates a graphic produced by a prognosis widget in accordance with various embodiments.

The file widget provides an area on the console to display various information items selected by a user. Examples of what can be shown by the file widget include photographs and text-based files. The file widget generally shows static information. FIG. 9 provides an example of the output of the prognosis widget. The example of FIG. 9 includes geologic forecast information 370 and prospect information 372. The geologic forecast information 370 includes horizontal depth 380 and lithography data 382 cross-referenced to various age formations. The forecast information 372 includes an identity of the geologic zones 384, seismic data 386, shallow hazard data 388, casing program information 390, and pressure prediction data 392 for the various age formations.

Basic Geosteering Widget

Figure 10:
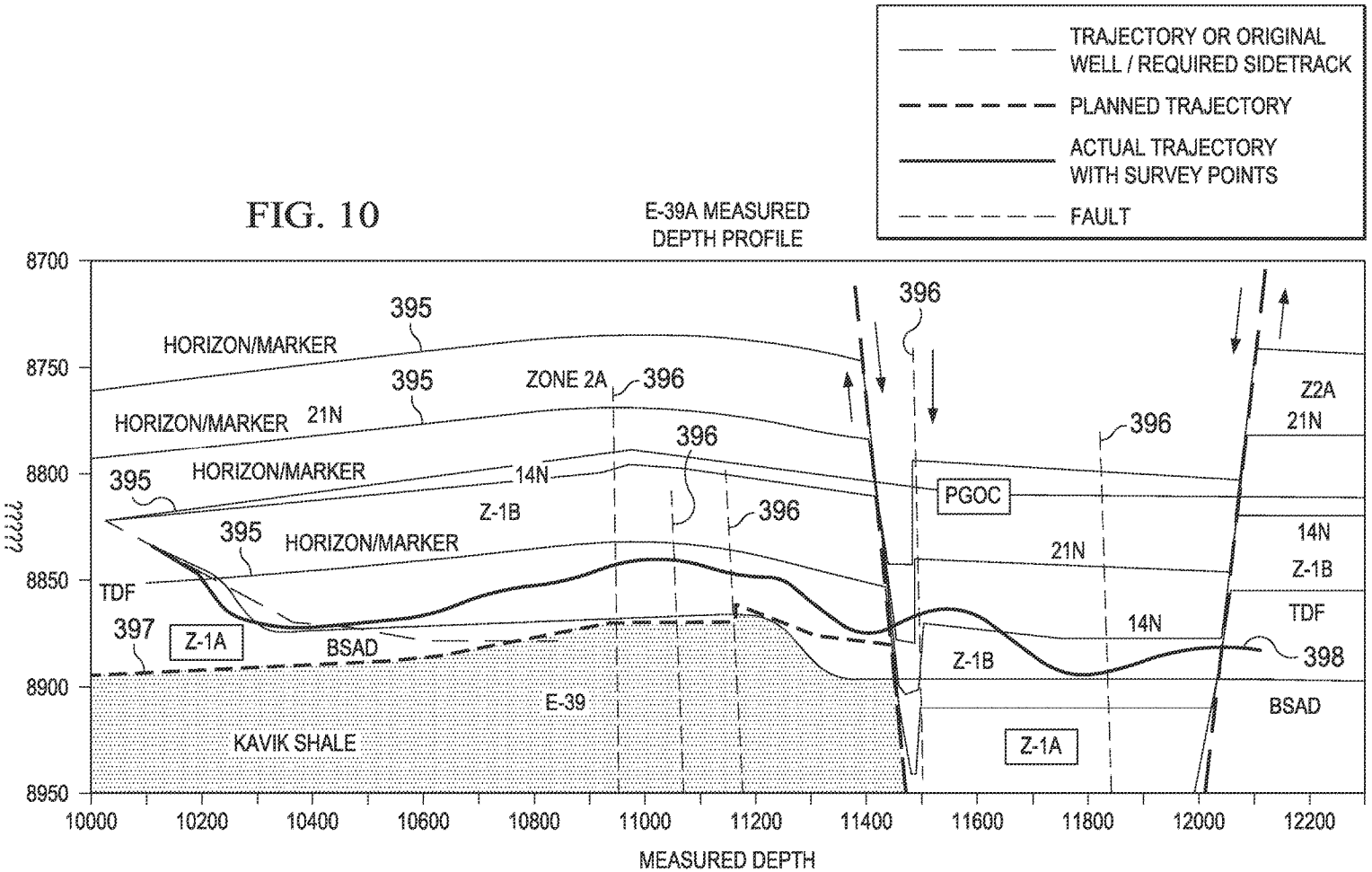
FIG. 10 illustrates a graphic produced by a basic geosteering widget in accordance with various embodiments.

The 3D overview widget provides the user with the ability to see some or all the same functionality of the Correlation widget. See FIG. 10 which illustrates a graphical representation generated by this widget. The display produced by this widget will show the planned trajectory 395 along side the actual well while drilling, and display horizons and faults 396 in a two-dimensional view. As desired, any of the data being acquired can be displayed by this widget (e.g., resistivity, sonic, a calculated curve, etc.). This widget accurately displays the directional information such as inclination to show the true trajectory 396 of the well versus the planned trajectory 397 and the planned horizon target in real time. The widget can also update the horizon or earth model interpretation based on the information received while drilling including, but not limited to, updates to predrill horizons, markers, faults, etc.

Time-Depth Trend Widget

The time-depth widget is used to compare the prognosis seismic time-depth curve to the actual time-depth relationship recorded with LWD sonic, wireline sonic, and VSP or checkshot measurements. This is a depth-indexed plot showing:

Continuous velocity from TVD corrected sonic

Interval velocity from vertically-corrected checkshots

Interval velocity used for depth conversion of the seismic (well plan)

Velocity from Checkshot corrected sonic

Console Layout

Figure 11:
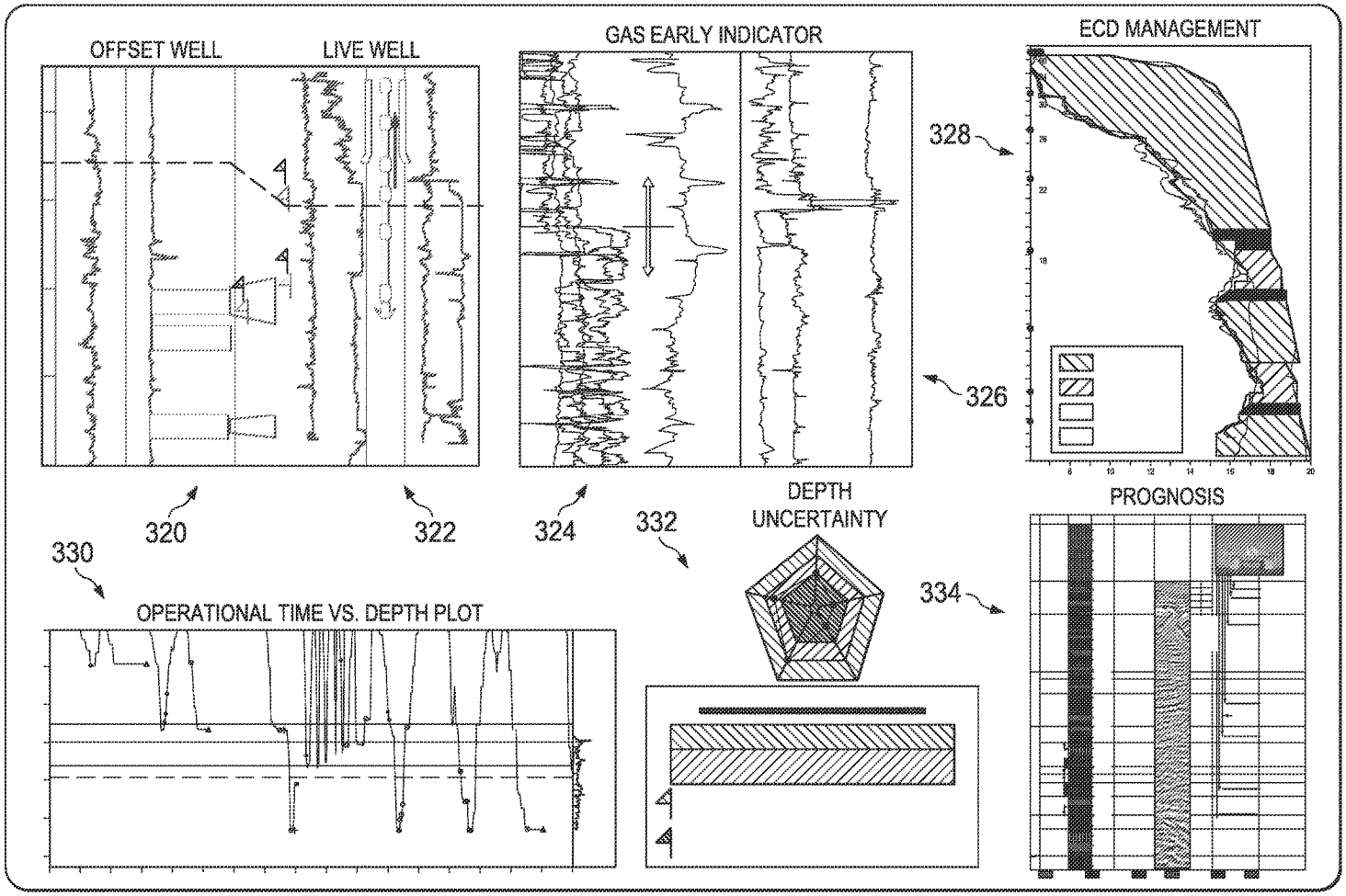
FIG. 11 shows an illustrative graphical user interface of real-time drilling information in accordance with various embodiments.

FIG. 11 illustrates one example of a console 320 generated by the RTWA software 115 and displayed, for example, on display 106. The console 320 includes various information areas populated by one or more of the various display widgets discussed above. The console 320 of FIG. 11 includes graphical representations produced by the correlation widget (shown at 322), the gas widget (at 324), the normalized gas widget (at 326), the mud weight widget (at 328), the operational time depth plot widget (at 330), the zone widget (at 332) and the prognosis widget (at 334). The information depicted in the console 320 can include static information, dynamically updated information, text, numerical values, graphs, uncertainty assessments, alerts, etc.

Method

Figure 12:
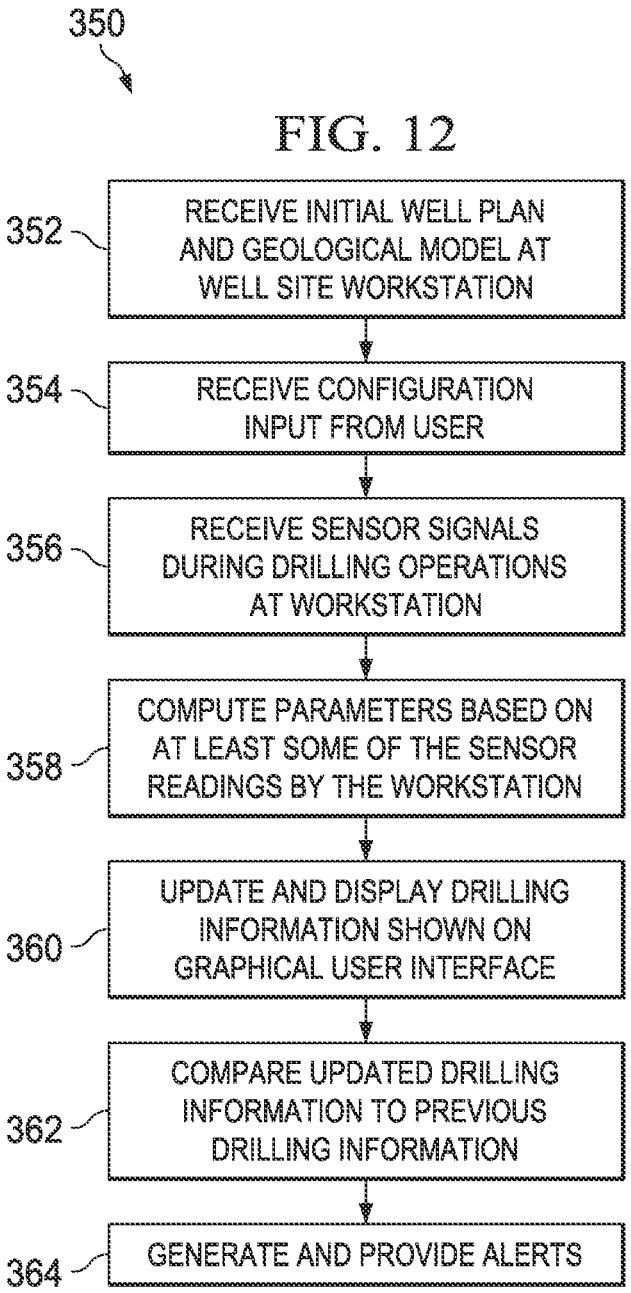
FIG. 12 shows a method in accordance with various embodiments.

FIG. 12 illustrates a method of controlling a drilling operation in accordance with various embodiments. The actions depicted in FIG. 12 can be performed in the order shown or in a different order, and generally are performed by the RTDM workstation 100 and RTWA software 115 executing on processor 102. At 352, the method includes receiving an initial well plan and geological model at the well site. The well plan and model can be electronically transmitted to the RTWA software 115 via network interface 108 (FIG. 1) or manually input directly into software 115 via input device 104 (FIG. 1). The geological model may include all or only some of the actual model.

The user configures one or more aspects of the operation of the software 115 at 354. For example, the user can configure alerts in terms of, for example, the data values or information alerts are to be generated for, the thresholds to trigger each alert, the type of alert such as pop-up windows, email alerts, audible alerts, etc. The user also can specify which, if any, tops can have their depth recomputed relative to the well plan. The depths of some tops may be known with such certainty that the user can configure the software not to readjust the depth of those particular tops. By way of an additional example, the user can specify which curves to populate the correlation widget. The user can also configure alerts for the various uncertainties depicted in FIG. 8 for the zone widget. For example, if any of the uncertainties enter the highest uncertainty level 309 (or whatever uncertainty level the user sets), an alert can be generated. Further, the user can specify the gasses and gas equations used to populate the gas and normalized gas widgets.

At 356, the method includes receiving sensor readings during drilling operations. The sensor readings are received by the RTMW 100. The sensor readings can include raw signals from the sensors 120, 130 themselves or processed versions of such signals.

At 358, the method includes computing various parameters, using one or more smart agents, based on at least some of the sensor signals. Such parameters can include any of a variety of parameters such as those described above. Examples include results of gas equations used in the operation of the gas and normalized gas widgets, lithography data, uncertainty assessments, location of the BHA in the correlation widget, etc. These parameters are dynamically computed and updated during the drilling operation and in real-time.

At 360, the software 115 then updates and displays the drilling information shown in GUI 300. The updates include updated location of the BHA, updated gas data in the gas and normalized gas widgets, updated uncertainty information, etc. The updates are performed in real-time and are provided to a user of the RTWA software 115 in the form of a single integrated GUI (e.g., GUI 300).

At 362, the method includes comparing the updated drilling information to previous drilling information. For example, the correlation widget enables various types of correlation to be performed as described above. Alerts, if any, are initiated at 364. Examples of alerts are provided above.

The above discussion is meant to be illustrative of the principles and various possible embodiments. Numerous variations and modifications will become apparent to those skilled in the art once the above disclosure is fully appreciated. It is intended that the following claims be interpreted to embrace all such variations and modifications.

What is claimed is:

1. A method of controlling a physical drilling operation, comprising:

receiving a well plan at a workstation on a drilling rig;

receiving sensor signals in real-time from sensors associated with the drilling rig;

generating updated drilling information based on said sensor signals;

updating uncertainty assessments of the physical drilling operation; and displaying said updated drilling information and uncertainty assessments on a display screen of said workstation;

displaying simultaneously on the display screen: a curve for an offset well from the well plan and a curve for a currently drilled well;

receiving selections of the offset well curve and the currently drilled well curve;

receiving a depth range input entered by a user;

computing a cross-correlation of said curves for a depth range specified by the depth range input, wherein the cross-correlation provides an estimate of depth shift between said curves;

plotting, on the display screen in conjunction with said curves, a correlation line showing different depths identified by the cross-correlation as corresponding to a same structure in the offset well and the currently drilled well; and adjusting the physical drilling operation at least in part based on the correlation line.

2. The method of claim 1 further comprising:

displaying uncertainties in a track with depth correspondence to the curves; and plotting, on the display screen in conjunction with said curves, a correlation line showing association between the uncertainties in the offset well and the currently drilled well.

3. The method of claim 1 further comprising configuring operation of said workstation including at least one of:

configuring an alert;

selecting a gas equation whose results are to be displayed in a graphical user interface (GUI) on said display screen;

selecting an uncertainty to be displayed in the GUI; and selecting a threshold uncertainty level associated with said selected uncertainty.

4. The method of claim 1 further comprising comparing an updated well plan to an initial well plan.

5. A real-time drilling monitor (RTDM) workstation, comprising:

a display; and a processor coupled to said display, wherein said processor receives sensor signals from a plurality of sensors, dynamically updates uncertainty assessments, and generates a single unified graphical user interface (GUI) populated with dynamically generated parameters based on said sensor signals, as well as static information and the dynamically updated uncertainty assessments; and a correlation widget that:

displays simultaneously on the GUI: a curve for an offset well from a well plan and a curve for a currently drilled well;

receives selections of the offset well curve and the currently drilled well curve;

receives a depth range input;

computes a cross-correlation of said curves for a depth range specified by the depth range input, wherein the cross-correlation provides an estimate of depth shift between said curves; and displays in conjunction with said curves a correlation line showing different depths identified by the cross-correlation as corresponding to a same structure in the offset well and the currently drilled well, wherein the processor is usable to adjust a physical drilling operation based at least on the correlation line.

6. The RTDM workstation of claim 5 wherein said processor dynamically updates said GUI during the physical drilling operation.

7. The RTDM workstation of claim 5 further comprising a correlation widget that permits the user to select a horizon or marker on a graphic of a currently drilled well and an offset well, and link together the selected horizon or maker as a correlated event.

8. The RTDM workstation of claim 5 further comprising a correlation widget that displays a curve for an offset well and a curve for a currently drilled well, and enables a user to select and drag all or a portion of one of said curves to be adjacent or on top of the curve from the other well.

9. The RTDM workstation of claim 5 further comprising a zone widget that displays assessments of a plurality of different types of uncertainties.

10. The RTDM workstation of claim 9 wherein said types of uncertainties include any one or more of depth uncertainty indicative of an uncertainty as to a depth, tolerance uncertainty indicative of tolerances between a bore wall or casing and an upset, sub-surface non-productive time, uncertainty management indicative of a number of uncertainties, and an equivalent circulating density (ECD) uncertainty.

11. The RTDM workstation of claim 9 wherein said zone widget displays a shape superimposed on a graphic depicting said plurality of different types of uncertainties, said shape indicative of a relative level of each of said uncertainty types.

12. The RTDM workstation of claim 5 further comprising software that permits a user to configure the operation of the workstation, said configuration including at least one of: configuring an alert, selecting a gas equation whose results are to be displayed in said GUI, selecting an uncertainty to be displayed in the GUI, and selecting a threshold uncertainty level associated with said selected uncertainty.

13. The RTDM workstation of claim 5, wherein the correlation widget is configured to:

display uncertainties in a track with depth correspondence to the curves; and plot, in conjunction with said curves, a correlation line showing association between the uncertainties in the offset well and the currently drilled well.

14. A non-transitory, computer-readable storage device comprising software that, when executed by a computer, cause the computer to:

receive signals from a plurality of sensors pertaining to a physical drilling operation;

dynamically compute parameters based on said sensor signals;

dynamically display said computed parameters during the physical drilling operation;

dynamically update uncertainty assessments of said physical drilling operation; and display a unified graphic indicative of said updated uncertainty assessments;

display simultaneously: a curve for an offset well from the well plan as well a curve for a currently drilled well;

receive selections of the offset well curve and the currently drilled well curve;

receive a depth range input;

compute a cross-correlation of said curves for a depth range specified by the depth range input, wherein the cross-correlation provides an estimate of depth shift between said curves;

plot, in conjunction with said curves, a correlation line showing different depths identified by the cross-correlation as corresponding to a same structure in the offset well and the currently drilled well; and cause adjustment of the physical drilling operation based at least in part on the correlation line.

15. The non-transitory, computer-readable storage device of claim 14 wherein said software causes the computer to:

display uncertainties in a track with depth correspondence to the curves; and plot, in conjunction with said curves, a correlation line showing association between uncertainties in the offset well and the currently drilled well.

16. The non-transitory, computer-readable storage device of claim 14 wherein said software causes the computer to permit a user to select and drag a curve or portion of a curve pertaining to the physical drilling operation to another curve pertaining to the physical drilling operation for visual comparison by a user.

17. The non-transitory, computer-readable storage device of claim 14 wherein said software causes the computer to display a dynamically updated uncertainty assessment pertaining to the physical drilling operation.

18. The non-transitory, computer-readable storage device of claim 14 wherein said uncertainty assessment is of an uncertainty comprising at least one of uncertainty as to a depth, tolerance uncertainty indicative of tolerances between a bore wall or casing and an upset, sub-surface non-productive time, uncertainty management indicative of a number of uncertainties, and an equivalent circulating density (ECD) uncertainty.

19. The non-transitory, computer-readable storage device of claim 14 wherein said software causes the computer to display a graphic depicting a plurality of different types of uncertainties, said shape indicative of a relative level of each of said uncertainty types.

20. The non-transitory, computer-readable storage device of claim 14 wherein said software causes the processor to receive input to configure the operation of the workstation, said configuration including at least one of: configuring an alert, selecting a gas equation whose results are to be displayed in said GUI, selecting an uncertainty to be displayed in the GUI, and selecting a threshold uncertainty level associated with said selected uncertainty.

* * * * *